US007227507B2

(12) United States Patent
Minard et al.

(10) Patent No.: US 7,227,507 B2
(45) Date of Patent: Jun. 5, 2007

(54) CIRCULAR POLARIZATION ANTENNA

(75) Inventors: Philippe Minard, Saint Medard sur Ille (FR); Ali Louzir, Rennes (FR); Franck Thudor, Rennes (FR); Françoise Le Bolzer, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/499,638

(22) PCT Filed: Dec. 17, 2002

(86) PCT No.: PCT/FR02/04376

§ 371 (c)(1),
(2), (4) Date: Apr. 18, 2005

(87) PCT Pub. No.: WO03/052872

PCT Pub. Date: Jun. 26, 2003

(65) Prior Publication Data

US 2005/0200542 A1 Sep. 15, 2005

(30) Foreign Application Priority Data

Dec. 19, 2001 (FR) ..... 01 16469

(51) Int. Cl.
*H01Q 13/10* (2006.01)
*H01Q 13/12* (2006.01)

(52) U.S. Cl. ..... 343/767; 343/769

(58) Field of Classification Search ..... 343/769, 343/770, 767

See application file for complete search history.

(56) References Cited

U.S. PATENT DOCUMENTS

| | | | | |
|---|---|---|---|---|
| 4,208,660 | A * | 6/1980 | McOwen, Jr. | 343/769 |
| 5,539,420 | A | 7/1996 | Dusseux et al. | |
| 5,714,961 | A * | 2/1998 | Kot et al. | 343/769 |
| 5,905,471 | A * | 5/1999 | Biebl et al. | 343/769 |
| 6,219,002 | B1 * | 4/2001 | Lim | 343/769 |
| 6,798,386 | B1 * | 9/2004 | Louzir | 343/840 |
| 6,914,574 | B2 * | 7/2005 | Fourdeux et al. | 343/769 |
| 6,917,342 | B2 * | 7/2005 | Thudor et al. | 343/770 |

FOREIGN PATENT DOCUMENTS

EP 426972 5/1991

OTHER PUBLICATIONS

X.M. Wing et al.: "Circularly polarised circular ring slot antenna fed by stripline hybrid coupler" Electronics Letter, IEE Stevenage, GB, vol. 35, No. 25, Dec. 9, 1999, pp. 2154-2155.

(Continued)

*Primary Examiner*—Tan Ho
(74) *Attorney, Agent, or Firm*—Joseph J. Laks; Robert D. Shedd; Brian J. Cromarty

(57) ABSTRACT

The present invention relates to a device for the reception and/or the transmission of electromagnetic signals comprising at least one means of reception and/or of transmission of electromagnetic signals, consisting of an antenna of the slot type and a feed line coupled electromagnetically with the slot of the antenna so as to connect the means of reception and/or of transmission of electromagnetic signals to means of utilization of the signals, the feed line being coupled electromagnetically with the slot at two points chosen such that the electromagnetic waves exhibit a circular polarization.

4 Claims, 2 Drawing Sheets

OTHER PUBLICATIONS

Figure 1A:
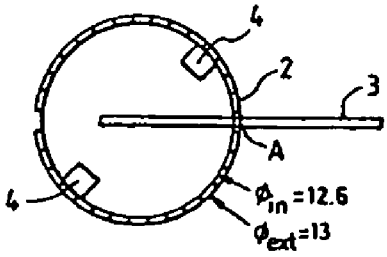
FIG.1a PRIOR ART

H. Tehrani et al: "A Multi-Frequency Microstrip-Fed Annular Slot Antenna" IEEE Antennas and Propagation Society International Symposium, 2000 Digest. APS, Salt Lake City, UT, Jul. 16-21, 2000, New York, vol. 2 of 4, Jul. 16, 2000, pp. 632-635.

* cited by examiner

CIRCULAR POLARIZATION ANTENNA

This application claims the benefit, under 35 U.S.C. 365 of International Application PCT/FR02/104376, filed Dec. 17, 2002, which was published in accordance with POT Article 21 (2) on Jun. 26, 2003 in French and which claims the benefit of French patent application No. 0116469, filed Dec. 19, 2001.

The present invention relates to a device for the reception and/or the transmission of electromagnetic signals, more particularly to a device comprising reception and/or transmission means consisting of an antenna of slot type, which can be used in the field of wireless transmissions, in particular in domestic networks, but also as basic element of a circular polarization antenna exhibiting a wide frequency band.

BACKGROUND OF THE INVENTION

Specifically, in wireless domestic networks, it is well known to the person skilled in the art, that on account of multiple reflections suffered by the signal before reaching the receiver, the polarization of the wave emitted is not conserved. Therefore, the antennas do not need to exhibit high purity of polarization. However, the frequency bandwidth demanded may be large. Specifically, for wireless domestic networks at 5 GHz, two disjoint frequency bands have been allocated in Europe according to the BRAN/HIPERLAN2 standard and in the United States, according to the IEEE-802.11A standard. Therefore, to completely cover these frequency bands, the antenna has to operate over a bandwidth of at least 575 MHz for Europe and at least 675 MHz for the United States. Consequently, the frequency band must be respectively around 11% and around 12.3% of the operating frequency.

Furthermore, if one wishes to produce equipment at low cost and in large number using these antennas, additional margins are required in order to take account of the influence of the variations on the parameters of the substrate and of the manufacturing tolerances on the centre frequency of the antenna. Therefore, the relative bandwidths sought are of the order of 15 to 20%.

Moreover, in order to make low-cost and compact antennas, it is known to use antennas of the printed antenna type. However, printed antennas operate in a narrow frequency band. More particularly, the performance in terms of bandwidth, namely the frequency band for which the reflection coefficient S11 at the point of excitation of the antenna is less than −10 dB, are fixed mainly by the parameters of the substrate used such as the relative permittivity, the thickness or the like and the choice of radiating element, which may be a patch, a slot or the like.

However, among printed antennas, it is known that the antennas of the slot type make it possible to obtain simple antenna structures at low cost exhibiting relatively larger bandwidths than the other printed structures.

It is also known that the antennas of the slot type, more particularly antennas constituted by an annular or polygonal slot, can radiate according to a circular polarization. In this case, the circular polarization can be obtained in two ways:

1/ by excitation at two points of two waves with orthogonal linear polarization of like amplitude and exhibiting a phase shift of 90°, as described for example in patent WO94/19842 in the name of THOMSON multimedia;

2/ by excitation at one point, the generation of the circular polarization being obtained by the introduction of a perturbation such as a notch or a protuberance in a plane situated at 45° from the point of excitation.

Figure 1B:
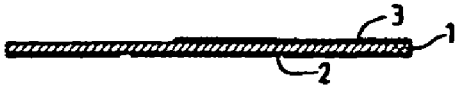
FIG.1b PRIOR ART

An antenna of this type is represented in FIGS. 1*a* and 1*b* which relate respectively to a plan view from above and to a sectional view of an antenna of annular slot type, fed by microstrip line, furnished with notches to obtain a circular polarization.

More precisely, the antenna is formed by a substrate 1 on one face of which has been deposited a metallic layer 3 in which a radiating element of the annular slot type 2 has been made. This annular slot is fed via a feed line 3 made by metallic deposition on the other face of the substrate 1. This feed line feeds the radiating element 2 by electromagnetic coupling at the point A between the line 3 and the slot 2. The dimension of the line between the point A and the end of the line is around λm/4 where λm is the guided wavelength for the line.

As represented in FIG. 1*a*, the slot 2 exhibits two diametrically opposed notches 4 lying in a plane situated substantially at 45° from the point of excitation A. Thus, this perturbation makes it possible to separate, in the frequency domain, the two initially degenerate orthogonal modes.

If the two methods described above, making it possible to obtain circular polarization, are compared it is appreciated that, when the circular polarization is obtained by excitation at two points, one obtains better quality of circular polarization over a wider frequency band than when the circular polarization is generated by perturbations in the annular slot.

The method using excitation at two points makes it possible to obtain a good ellipticity ratio or ARBW (standing for Axial Ratio Bandwidth) with a widened adaptation band.

SUMMARY OF THE INVENTION

The aim of the present invention is therefore to propose a novel device for the reception and/or the transmission of electromagnetic signals, comprising a radiating element consisting of an annular slot antenna and a feed line which make it possible to obtain a circular polarization over much greater matching bandwidths than the bandwidths obtained with the devices of the prior art.

Consequently, a subject of the present invention is a device for the reception and/or the transmission of electromagnetic signals comprising at least one means of reception and/or of transmission of electromagnetic signals consisting of a slot antenna and a feed line coupled electromagnetically with the slot so as to connect the means of reception and/or of transmission of electromagnetic signals to means of utilization of the signals, characterized in that the feed line is coupled electromagnetically with the slot type antenna at two points chosen such that the electromagnetic waves exhibit a circular polarization.

According to a preferential embodiment:

the length of the slot between the two coupling points is of the order of λs/4 with λs the guided wavelength in the slot, in the case of a slot of perimeter λs, i.e. a quarter of the perimeter of the slot the length of the line between the two coupling points is of the order of k'λm/4 with λm the guided wavelength under the feed line and k' an odd integer and, the length between the end of the feed line and the first coupling point is of the order of λm/8 modulo λm/2 with λm the guided wavelength under the feed line and terminating in an open circuit.

Thus, with a structure as described above, on account of the distribution of the electromagnetic fields along the feed line terminating in an open circuit and of the identical geometrical configurations at the point of intersection of the slot with the feed line, the slot is excited at the points A1 and A2 by signals having identical amplitudes and a phase shift of 90°. These conditions allow the obtaining of circular polarization for the means of reception and/or of transmission of electromagnetic signals.

According to another characteristic of the present invention, the device comprises several means of reception and/or of transmission of electromagnetic signals consisting of an antenna of the slot type nested inside one another and a feed line coupled electromagnetically with the slot of each means at two points chosen such that the electromagnetic waves emitted by each means exhibit a circular polarization.

Moreover, the feed line is a microstrip line or a coplanar line and the means of reception and/or of transmission of electromagnetic signals consisting of an antenna of the slot type include the slots of annular or polygonal shape such as square, rectangular, diamond-shaped or the like.

BRIEF DESCRIPTION OF THE INVENTION

Figure 2A:
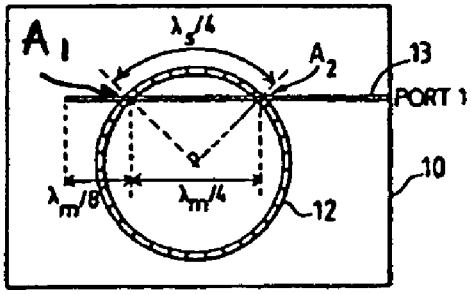
Figure 2B:
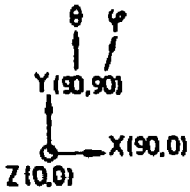
Figure 2B:
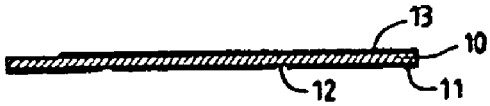
Figure 3:
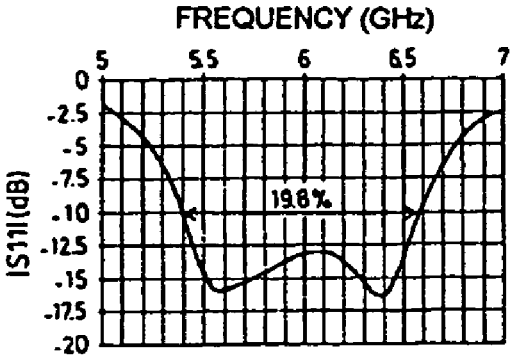
Figure 4:
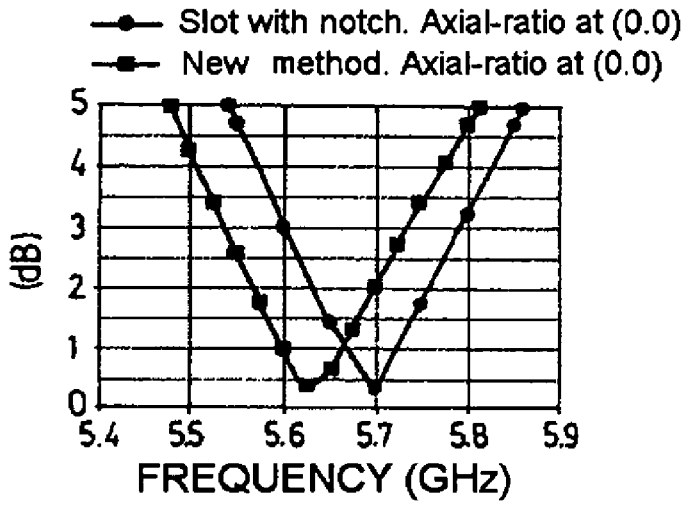

Other characteristics and advantages of the present invention will become apparent on reading the description of various embodiments, this description being given with reference to the appended drawings in which:

FIGS. 1*a* and 1*b* respectively represent a plan view from above and a sectional view of a device according to the prior art, FIGS. 2*a* and 2*b* respectively represent a plan view from above and a sectional view of a first embodiment of a device according to the present invention, FIG. 3 is a curve giving the modulus of the coefficient of reflection S11 expressed in dB as a function of the frequency of the device of FIG. 2, FIG. 4 is a curve giving the ellipticity ratio for the devices of FIGS. 1 and 2, and FIGS. 5 and 6 are plan views from above of two variant embodiments of the present invention.

DESCRIPTION OF PREFERRED EMBODIMENTS

A first embodiment of the present invention will firstly be described with reference to FIGS. 2 to 4.

As represented in FIGS. 2*a* and 2*b*, a device for the reception and/or the transmission of circularly polarized electromagnetic signals in accordance with the present invention consists of an antenna of the annular slot type 12, which is fed by electromagnetic coupling via a feed line 13 linked at the level of the port 1 to means of utilization of the signals that are well known to the person skilled in the art.

More specifically, a metallization 11 exhibiting a thickness t=17.5E-3 mm has been deposited on a substrate 10 consisting for example of a Rogers 4003 substrate exhibiting a height H=0.81 mm, a permittivity Er=3.38, a TanD=0.0027.

As represented in FIG. 2*b*, an annular slot 12 has been made in this metallization. The annular slot 12, as represented in FIG. 2*a*, exhibits a perimeter of the order of λs. This annular slot therefore operates on its fundamental mode. In the embodiment represented, λs is chosen such that the central operating frequency is around 5.8 GHz.

As represented in the figures, a feed line has been made by deposition of a metallization on the opposite face of the substrate 10 to the face comprising the metallization 11. This feed line 13 is positioned in such a way as to be electromagnetically coupled with the slot 12 at two points A1, A2 which lie at 90° to one another. Therefore, the length of the slot between the two points A1 and A2 is of the order of λs/4 with λs the guided wavelength in the slot, in the case of a slot of perimeter λs, i.e. a quarter of the perimeter of the slot.

Moreover, in accordance with the present invention, the length of the excitation line 13 between the two coupling points A1 and A2 is of the order of k'λm/4 where λm is the guided wavelength of the feed line 13 and k' is an odd integer. The feed line 13 consists of a microstrip line, in the embodiment represented. To obtain this value, the width of the microstrip line is optimized.

Thereafter, in accordance with the present invention, the wavelength between the end of the feed line 13 and the coupling point A1 is of the order of λm/8 modulo λm/2 with λm the guided wavelength of the feed line 13. This feed line 13 terminates in an open circuit. Moreover, the overrun of the line beyond the point A2 makes it possible to match the annular slot to the measurement apparatus used.

A structure of the above type has been made for simulation. It was made on a Rogers 4003 substrate as described above with the following characteristics: the annular slot exhibits an inside diameter ϕin=12.6 and an outside diameter ϕex=13 and an impedance Zs=108.5 Ω. The feed line 13 made by a microstrip technique, exhibits a characteristic impedance Zm=134.5 ohms, a width of 0.2 mm and cuts the annular slot at a distance from the point of tangency parallel to the line of 1.895 mm. In this case, the simulation results are given for the reflection coefficient S 11 by the curve represented in FIG. 3. It is appreciated that at −10 dB a frequency band corresponding to 19.8% of the operating frequency is obtained, namely a frequency band that is larger than with the conventional systems and makes it possible to comply with the constraints of the European and American standards.

Moreover, represented in FIG. 4 is the ellipticity rate, namely the AR-BW for a conventional device as represented in FIG. 1, consisting of a slot with notch and for a device according to the present invention, as represented in FIGS. 2, consisting of a slot coupled to a feed line placed in a specific manner. The results obtained in FIG. 4 show that the AR-BWs of the two antennas are equivalent with a slight displacement of the operating frequency.

Thus, with the structure according to the present invention, broadband operation is obtained while conserving entirely satisfactory circular polarization.

Other embodiments of the present invention will now be described with reference to FIGS. 5 and 6.

Figure 5:
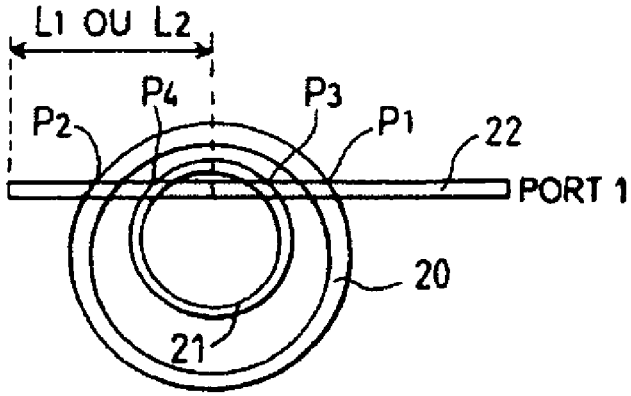
Figure 6:
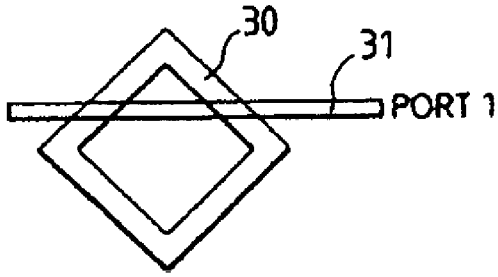

Represented in FIG. 5 is a plan view from above of another embodiment comprising two mutually nested means of reception and/or of transmission of electromagnetic waves with circular polarization.

More specifically, represented therein is a first annular slot 20 and a second annular slot 21, the two slots being fed by a common feed line 22 made by a microstrip technique. This feed line 22 is coupled electromagnetically with the slots 20 and 21 according to the criteria making it possible to obtain circularly polarized waves.

More specifically, the line 22 is coupled with the annular slot 20 at the points P1 and P2, in such a way that the length between P1 and P2 is of the order of k'λm/4 where λm is the guided length of the line. The length of the slot 20 between P2 and P1 is chosen to be of the order of λs/4 where λs is dependent on the frequency f1 of operation of the antenna 20 in its fundamental mode and the feed line 22 between P2 and the end of the line 22 in open circuit is of the order of λm/8 modulo λm/2 where λm is the guided wavelength under the line 22.

Moreover, the line 22 is also coupled electromagnetically with the slot 21 at two points P3 and P4 chosen in such a way that the length of line between P4 and P3 is of the order of k"λ/4, the length of the slot between P4 and P3 is of the order of λ's/4, where λ's is dependent on the frequency f2 of operation of the antenna 21 in its fundamental mode and the length of line between P4 and the end of the line 22 is of the order of λm/8 modulo λm/2. In this case, the perimeters of the two slots 20, 21 give the two operating frequencies of the two antennas and the specific coupling of the feed line 22 with the two slots makes it possible to obtain operation with circular polarization at the two different frequencies such as f1 and f2.

In the embodiment above, the two slots 20, 21 are nested in such a way that the length L1 of the microstrip line at the frequency f1 between the open circuit and the middle of the two points of intersection P2-P1 with the slot 20 is equal to the length L2 of the microstrip line at the frequency f2 between the open circuit and the middle of the two points of intersection P3-P4 with the slot 21.

Furthermore, L1 is of the order of kλm1/4 (k an odd integer) and L2 is of the order of kλm2/4 (k an odd integer). Therefore, depending on the ratios of L1 to L2 and the choice of the values k' and k", various configurations may be envisaged for the nested slots which may for example be tangent at a point or exhibit a crenellated feed line structure.

Another embodiment of the present invention will now be described with reference to FIG. 6. In this case, the slot 30 is constituted by a polygon such as a diamond, which is fed by a feed line 31 which cuts the diamond in such a way as to comply with the constructional criteria in accordance with the present invention.

The present invention has been described while referring to particular embodiments. However, it is obvious to the person skilled in the art that the shape of the slot type antenna may be modified in numerous ways, in particular the slot may be constituted by a square, a rectangle or any other similar polygon and that the feed line can also be made by a different technology such as coplanar technology.

The invention claimed is:

1. Device for the reception and/or the transmission of electromagnetic signals comprising at least one means of reception and/or of transmission of electromagnetic signals consisting of an antenna of the annular slot type and a feed line coupled electromagnetically with the slot of the antenna so as to connect the means of reception and/or of transmission of electromagnetic signals to means of utilization of the signals, wherein the feed line being coupled electromagnetically with the slot at two points, wherein the two points of electromagnetic coupling between the slot of the antenna of the slot type and the feed line are chosen such that:

the length of the slot between the two coupling points is of the order of λs/4 with λs the guided wavelength in the slot, in the case of a slot of perimeter λs, the length of the feed line between the two coupling points is of the order of k'λm/4 with λm the guided wavelength under the feed line and k' an odd integer and, the length between the end of the feed line and the first coupling point is of the order of λm/8 modulo λm/2 with λm the guided wavelength for the feed line and terminating in an open circuit.

2. Device according to claim 1, wherein it comprises several means of reception and/or of transmission of electromagnetic signals consisting of an antenna of the slot type nested inside one another and a feed line coupled electromagnetically with the slot of each means at two points.

3. Device according to claim 1, wherein the feed line is a microstrip line or a coplanar line.

4. Device according to claim 1, wherein the means of reception and/or of transmission of electromagnetic signals consisting of an antenna of the slot type are constituted by slots of annular or polygonal shape.

* * * * *